US008060363B2

(12) United States Patent
Rämö et al.

(10) Patent No.: US 8,060,363 B2
(45) Date of Patent: Nov. 15, 2011

(54) AUDIO SIGNAL ENCODING

(75) Inventors: Anssi Rämö, Tampere (FI); Lasse Laaksonen, Nokia (FI); Adriana Vasilache, Tampere (FI)

(73) Assignee: Nokia Corporation, Espoo (FI)

( * ) Notice: Subject to any disclaimer, the term of this patent is extended or adjusted under 35 U.S.C. 154(b) by 1074 days.

(21) Appl. No.: 11/706,134

(22) Filed: Feb. 13, 2007

(65) Prior Publication Data

US 2008/0192947 A1 Aug. 14, 2008

(51) Int. Cl.

| | |
|---|---|
| ***G10L 21/02*** | (2006.01) |
| ***G10L 19/02*** | (2006.01) |
| ***G10L 19/00*** | (2006.01) |

(52) U.S. Cl. ..... 704/227; 704/226; 704/229; 704/500

(58) Field of Classification Search ..... None
See application file for complete search history.

(56) References Cited

U.S. PATENT DOCUMENTS

| | | | | |
|---|---|---|---|---|
| 5,659,622 | A * | 8/1997 | Ashley | 381/94.1 |
| 6,233,550 | B1 | 5/2001 | Gersho et al. | |
| 6,604,070 | B1 * | 8/2003 | Gao et al. | 704/222 |
| 6,799,161 | B2 * | 9/2004 | Yokoyama | 704/226 |
| 6,862,567 | B1 * | 3/2005 | Gao | 704/228 |
| 7,366,658 | B2 * | 4/2008 | Moogi et al. | 704/205 |
| 7,430,506 | B2 * | 9/2008 | Nam et al. | 704/207 |
| 7,558,729 | B1 * | 7/2009 | Benyassine et al. | 704/226 |
| 7,702,504 | B2 * | 4/2010 | Son et al. | 704/219 |
| 2005/0096904 | A1 | 5/2005 | Taniguchi et al. | |

FOREIGN PATENT DOCUMENTS

| | | |
|---|---|---|
| CN | 1598926 A | 3/2005 |
| RU | 2004127121 | 8/2009 |
| SU | 1660188 | 6/1991 |

OTHER PUBLICATIONS

Jelinek, M. et al. "On the architecture of the CDMA2000® variable-rate multimode wideband (VMR-WB) speech coding standard," Int. Conf. on Acoustics, Speech & Signal Processing, Montreal, Canada, May 17-21, 2004, vol. 1, pp. 281-284.*

3GPP2: "Source-Controlled Variable-Rate Multimode Wideband Speech Codec (VMR-WB) Service Option 62 for Spread Spectrum Systems;" Jun. 11, 2004; pp. 1-164; paragraph 5—Functional description of the VMR-WB Encoder at pp. 39-122; paragraph 5.15—Target Signal Computation on p. 93; and Figure 4.1-2 on p. 29.

Draft new ITU-T Recommendation G.729.1 (ex G.729EV); G.729 based Embedded Variable bit-rate (G.729EV) coder: An 8-32 kbit/s scalable wideband coder bitstream interoperable with G.729; AAP Summary.

"The Adaptive Multirate Wideband Speech Codec (AMR-WB);" B. Bessette et al; IEEE Transactions on Speech and Audio Processing, vol. 10, No. 8; Nov. 2002.

"Wideband Speech Coding for CDMA2000 Systems;" S. Ahmadi et al; IEEE 2003.

"Pyramid CELP: Embedded Speech Coding for Packet Communications;" C. Erdmann, et al; IEEE 2002.

U.S. Appl. No. 11/515,499, filed Sep. 1, 2006, Ramo et al.

* cited by examiner

*Primary Examiner* — Matthew Sked
(74) *Attorney, Agent, or Firm* — Alfred A. Fressola; Ware, Fressola, Van Der Sluys & Adolphson LLP

(57) ABSTRACT

For an audio coding, noise suppression is applied to an original audio signal to obtain an audio signal with reduced noise. A coding mode is selected based on the audio signal with reduced noise. The original audio signal is then encoded using this selected coding mode.

23 Claims, 3 Drawing Sheets

AUDIO SIGNAL ENCODING

FIELD OF THE INVENTION

The invention relates to the encoding of an audio signal. It relates more specifically to a method, apparatuses, a device, a system and a computer program product supporting such an encoding.

BACKGROUND OF THE INVENTION

Audio signals, like speech, are encoded for example for enabling an efficient transmission or storage of the audio signals.

Speech encoders and decoders (codecs) are usually optimized for speech signals, and quite often, they operate with a fixed bit rate.

An audio codec can also be configured to operate with varying bit rates, though. At the lowest bit rates, such an audio codec may work with speech signals as well as a pure speech codec at similar rates. At the highest bit rates, the performance may be good with any signal, including music and background noises, which may be considered as a part of the audio signal instead of just noise.

A further audio coding option is an embedded variable rate speech coding, which is also referred to as a layered coding. Embedded variable rate speech coding denotes a speech coding, in which a bit stream is produced, which comprises primary coded data generated by a core encoder and additional enhancement data, which refines the primary coded data generated by the core encoder. A subset or subsets of the bit stream can then be decoded with good quality. ITU-T standardization aims at a wideband codec of 50 to 7000 Hz with bit rates from 8 to 32 kbps. The codec core will work with 8 kbps and additional layers with quite small granularity will increase the observed speech and audio quality. Minimum target is to have at least five bit rates of 8, 12, 16, 24 and 32 kbps available from the same embedded bit stream.

When encoding audio signals, noise suppression may be used in some cases as a processing step preceding the actual encoding in order to improve the sound quality. Especially lower bit rates may benefit from noise suppression, as it may allow obtaining reasonably good output quality in a noisy environment.

The low bit rate performance of a codec operating without noise suppression suffers, because the codec tries to reproduce the whole signal, which includes the noise component. As a result, there are not enough bits to preserve the waveform and key speech characteristics. This problem decreases with an increasing bit rate.

Higher bit rates may thus result in a high audio quality without any pre-processing. In the case of music signals, noise suppression may even add additional distortions to the signal. In order to achieve a high quality coding with variable bit rates, it is thus possible to use more noise suppression in low bit rate speech encoding, but no noise suppression in higher bit rate audio/speech encoding.

Also with embedded variable bit rate coding, the lower bit rates, in this case mainly 8 and 12 kbps, would benefit from noise suppression, while higher bit rates would result in the highest speech and audio quality without any pre-processing. In this case, it would be possible to employ an adaptive noise suppression approach. That is, a first amount of noise suppression could be applied to an audio signal and the resulting signal could be encoded with a core encoder. In addition, a second amount of noise suppression or no noise suppression could be applied to the same audio signal, and the resulting signal could be used for generating enhancement data.

In addition to different bit rates, an audio coder may also select between different coding modes for encoding an audio signal. A first coding mode may be optimized for instance for speech, a second for music and a third for mixed signals, etc. A respective coding mode may be selected for example based on determined parameters of a signal that is to be encoded.

SUMMARY

The invention proceeds from the consideration that it might not always be desirable to apply noise suppression to an audio signal that is to be encoded, in spite of the above mentioned negative effects in the case of low bit rate coding.

When there is no noise suppression in spite of strong background noise, however, a low bit rate codec tends moreover to choose a non-optimal coding mode. Applying a non-optimal coding mode, in turn, limits the quality of the encoding and makes the negative effect of the limited number of bits in the case of a low bit rate coding even more pronounced. A non-optimal mode may frequently be selected due to the fact that the codec tries to reproduce also the noise characteristics in the signal, not only the speech characteristics. As a result, coding modes for unvoiced speech, which is noise-like, and especially generic coding modes, which try to encode all the frames not classified for a specialized encoding, are used too much for noisy speech in codecs that have optimized solutions especially for voiced speech and voicing transitions.

While it would be possible to design the mode selection such that it works as well as possible for both clean and noisy signals, such an approach is obviously a compromise in performance between clean and noisy signals. It also requires a significant amount of work to fine-tune the mode classifier for all types of background noise, including inter alia office noise, street noise, car noise, interfering talker noise, etc.

A method is described, which comprises applying a noise suppression to an original audio signal to obtain an audio signal with reduced noise. The method further comprises selecting a coding mode based on the audio signal with reduced noise. The method further comprises encoding the original audio signal using the selected coding mode.

Moreover, an apparatus is described, which comprises a noise suppression component configured to apply a noise suppression to an original audio signal to obtain an audio signal with reduced noise. The apparatus further comprises a selection component configured to select a coding mode based on an audio signal with reduced noise provided by the noise suppression component. The apparatus further comprises a coding component configured to encode the original audio signal using a coding mode selected by the selection component.

The components of the described apparatus can be implemented in hardware and/or software. They may be realized for instance by a processor executing software program code for realizing the required functions. Alternatively, they could be implemented for example in a circuit, for instance in a chipset or a chip, like an integrated circuit. Further, the described apparatus can comprise only the mentioned components, but it may also comprise additional components.

Moreover, an electronic device is described, which comprises the described apparatus and in addition an audio signal interface. The audio signal interface can be for instance a microphone or a connector for a microphone, but equally an interface to some other device providing audio signals.

Moreover, an apparatus is described, which comprises a decoding component arranged to decode an audio signal encoded in accordance with the described method.

Moreover, a system is described, which comprises the described apparatus, and in addition another apparatus including a decoding component configured to decode an audio signal encoded by the described apparatus.

Finally, a computer program product is proposed, in which a program code is stored in a computer readable medium. The program code realizes the proposed method when executed by a processor. The computer program product could be for example a separate memory device, or a memory that is to be integrated in an electronic device.

The invention is to be understood to cover such a computer program code also independently from a computer program product and a computer readable medium.

The performance of an audio coding without noise suppression could often be improved, if available specialized coding modes were utilized more often during background noise. This could be achieved by applying noise suppression to an audio signal only for determining the coding mode, as described. The actual coding is then applied to the original audio signal using the selected coding mode. The decision on the coding mode is thus based on a de-noised signal while still encoding the noisy signal and maintaining its key characteristics. As a result, the optimal coding mode can be selected also with background noise without affecting the mode selection for clean signals.

The presented approach is suited to improve the coding performance in the case of background noise over a conventional coding without noise suppression. In addition, there is no need to base mode design and mode selection on a compromise between clean and noisy signals, as it can be assumed that the signal for which the mode is selected is always clean. In addition, a possibly not desired encoding of a de-noised audio signal can be avoided. As a result, the naturalness of the signal is preserved and no additional distortions are introduced that can sometimes be heard in de-noised signals. The presented approach is also suited to alleviate negative effect of the limited number of bits in the case of a low bit rate coding to some extent.

It is to be understood that the expression "original audio signal" is only used to provide a differentiation over the "audio signal with reduced noise". Thus, any suitable kind of pre-processing of an original audio signal may precede the noise suppression of the original audio signal and/or the encoding of the original audio signal.

In one embodiment, a parameter analysis is applied to the audio signal with reduced noise. The results of the analysis can then be used as a basis for selecting the coding mode.

With some types of analyses, the results of the parameter analysis alone might not be a sufficient basis for selecting the coding mode in a reliable manner. In these cases, additional information may be used, in particular, though not exclusively, the audio signal with reduced noise. Such a parameter analysis can be for instance a pitch analysis. In this case, the resulting parameter values, in particular the pitch estimate, could be used in addition in the encoding of the original audio signal.

The presented approach can be employed with any audio coding scheme that enables a coding with a selected one of a plurality of available coding modes. It can be used for instance with a variable bit rate coding scheme, like an embedded variable bit rate coding scheme.

If the presented approach is used with a variable bit rate coding scheme, the coding mode selection based on an audio signal with reduced noise could be employed exclusively for the lower bit rates, not for the higher bit rates, even though such a distinction is not required.

The described apparatus can be or comprise for instance, though not exclusively, an encoder, like a variable bit rate—embedded variable rate (VBR-EV) coder.

The electronic device can be for instance a mobile terminal or a personal computer, but equally any other device that is to be used for encoding audio data.

The described approach can be employed for instance for encoding audio signals for transmissions via a packet switched network, for instance for Voice over IP (VoIP), or for transmissions via a circuit switched network, for instance in a global system for mobile communication (GSM). The described approach can also be employed for encoding audio signals for transmissions via other types of networks or for encoding audio signals independently of any transmission.

It is to be understood that the features and steps of all presented embodiments can be combined in any suitable way.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

DETAILED DESCRIPTION OF THE INVENTION

Figure 1:
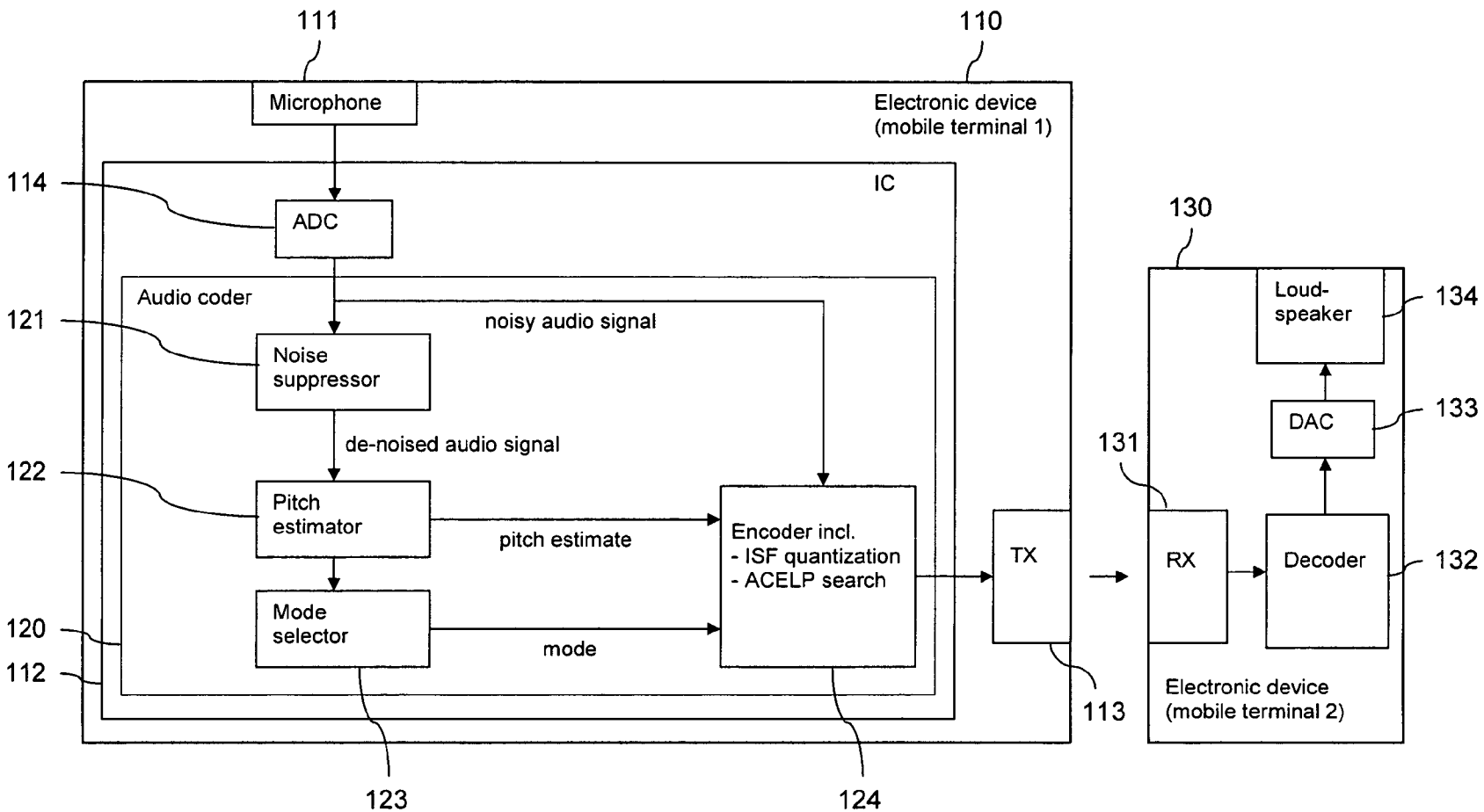
FIG. 1 is a schematic block diagram of a system according to an embodiment of the invention.

FIG. 1 is a schematic block diagram of a system, which enables a coding mode selection in accordance with a first embodiment of the invention.

The system comprises a first electronic device 110 and a second electronic device 130. The system could be for instance a mobile communication system, in which the electronic devices 110, 130 are mobile terminals.

The first electronic device 110 comprises a microphone 111, an integrated circuit (IC) 112 and a transmitter (TX) 113. The integrated circuit 112 or the electronic device 110 could be considered as an exemplary embodiment of the apparatus according to the invention.

The integrated circuit 112 comprises an analog-to-digital converter (ADC) 114 and an audio coder portion 120. The audio coder portion 120 comprises a noise suppressor 121, a pitch estimator 122, a mode selector 123 and an encoder 124. The microphone 110 is linked to the analog-to-digital converter 114. The analog-to-digital converter 114 is further linked on the one hand to the noise suppressor 121 and on the other hand to the encoder 124. The noise suppressor 121 is moreover linked via the pitch estimator 122 and the mode selector 123 to the encoder 124. The pitch estimator 122 is linked in addition directly to the encoder 124. The encoder 124, finally, is linked to the transmitter 113.

The encoder 124 can be chosen as desired. It could be for instance an embedded variable rate speech coder, which comprises a core encoder and a number of enhancement layer coders. The core encoder could then be an algebraic code excited linear prediction (ACELP) coder, for example an adaptive multirate wideband (AMR-WB) coder or a variable-rate multimode wideband (VMR-WB) coder. The selection of the enhancement layer coders could depend on, for example, whether the purpose of the enhancement layers is to maximize error resilience, to maximize output speech quality or to obtain good quality coding of music signals, etc.

It is to be understood that the electronic device 110 could comprise various other components not shown. The integrated circuit 112 could comprise additional components, too. Further, it is to be understood that the analog-to-digital converter 114 could also be arranged external to the integrated circuit 112 and that the microphone 111 could also be realized in the form of an accessory to the electronic device 110. Moreover, it has to be noted that microphone 111, analog-to-digital converter 114, audio coder 120 and transmitter 113 could also be connected to each other via one or more other components of the first electronic device 110.

The second electronic device 130 comprises, linked to each other in this order, a receiver (RX) 131, a decoder 132, a digital-to-analog converter 133 and loudspeakers 134.

It is to be understood that also the electronic device 130 could comprise various other components not shown, and that the loudspeakers 134 could also be realized in the form of an accessory device. Further, it has to be noted that receiver 131, decoder 132, digital-to-analog converter 133 and loudspeakers 134 could also be connected to each other via one or more other components of the electronic device 130.

Figure 2:
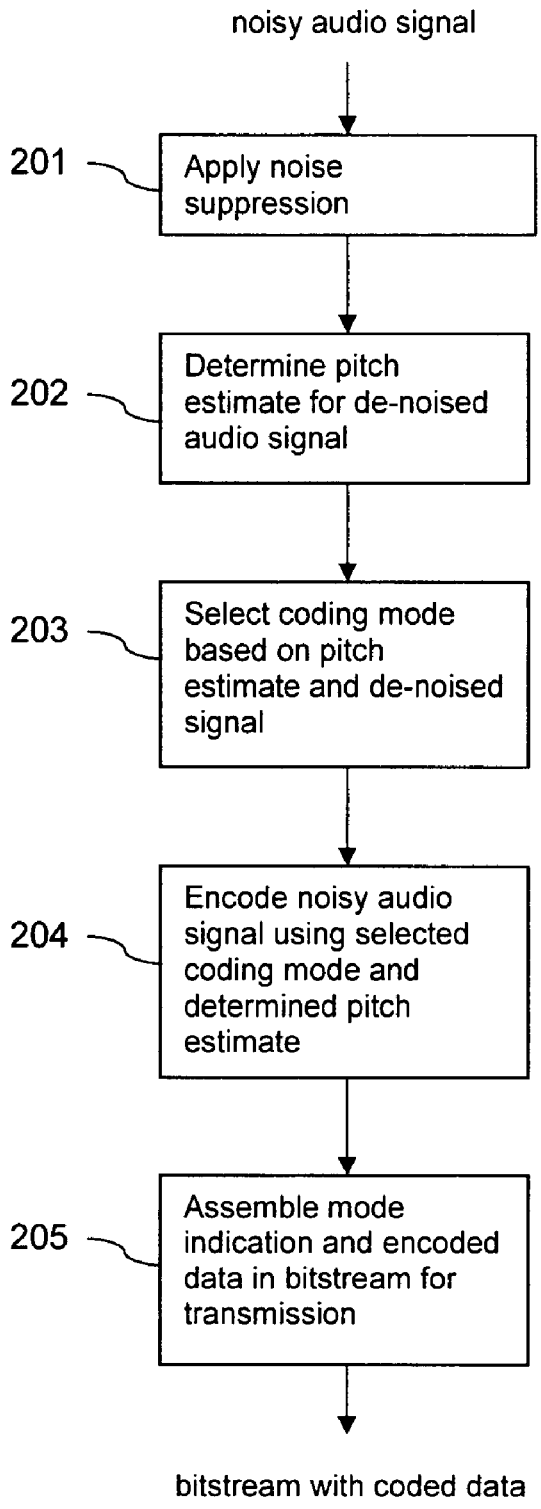
FIG. 2 is a flow chart illustrating an operation in the communication system of FIG. 1.

An exemplary operation according to the invention in the system of FIG. 1 will now be described with reference to FIG. 2. FIG. 2 is a flow chart illustrating the processing within the audio coder 120.

A user of the first electronic device 110 may use the microphone 111 for inputting audio data that is to be transmitted to the second electronic device 130 via a mobile communication network.

The analog-to-digital converter 114 converts the analog audio signal received via the microphone 111 into a digital audio signal.

The audio coder 120 receives the digital audio signal from the analog-to-digital converter 114.

Within the audio coder 120, the received audio signal is provided to the noise suppressor 121.

The noise suppressor 121 applies a noise suppression to the received audio signal (step 201). The amount of noise suppression may be set for instance to 14 dB, but equally to any other desired value.

The resulting de-noised signal is provided to the pitch estimator 122. The pitch estimator 122 performs a regular pitch estimation on the de-noised signal (step 202), and provides the resulting pitch estimate to both the mode selector 123 and the encoder 124.

The mode selector 123 receives in addition the de-noised signal, either directly from the noise suppressor 121 or via the pitch estimator 122. The mode selector 123 utilizes the received pitch estimate and the received de-noised signal to select a suitable coding mode (step 203) and indicates the selected mode to the encoder 124. Since also the pitch estimate has been determined based on a de-noised signal, the background noise does not affect the mode selection. The selected mode can thus be expected to be particularly suited for the intentionally input audio data.

The encoder 124 receives the noisy audio signal, the pitch estimate and the indication of the selected coding mode.

The encoder 124 applies an encoding in accordance with the selected coding mode to the received noisy audio signal (204). By applying the encoding to the noisy audio signal, the naturalness of the signal is preserved.

The encoding based on the noisy audio signal may include for example an immitance spectral pair in frequency domain (ISF) quantization and an ACELP codebook search. The required pitch estimate may be determined again based on the noisy audio signal, but it may also be used as provided by the pitch estimator 122.

In the case of an embedded variable rate speech coder, the core encoder encodes the noisy audio signals for example with a bit rate of 8 kbps, and provides the resulting coded data to the first enhancement layer. The first enhancement layer receives the coded data and the noisy audio signal and generates enhancement data for the coded data with an additional bit rate of 4 kbps. Further enhancement layers may generate further enhancement data, for instance with a respective additional bit rate of 4 kbps, 8 kbps and further 8 kbps.

The coded data and the enhancement layer data are assembled together with a coding mode indication in a single embedded bit stream, which is provided to the transmitter 113. The transmitter 113 transmits the embedded bit stream via a mobile communication network to the second electronic device 130 (step 205). The receiver 131 of the second electronic device 130 receives the embedded bit stream and provides it to the decoder 132. The decoder 132 decodes all or a subset of the embedded bit stream to regain digital audio data. The decoder 132 may use to this end only the coded data at a bit rate of 8 kbps. Alternatively, it could use in addition the enhancement layer data of one or more layers and thus a total bit rate of 12 kbps, 16 kbps, 24 kbps or 32 kbps.

The decoded digital audio data is provided to the digital-to-analog converter 133, which converts the digital audio data into analog audio data. The analog audio data may then be presented to a user via the loudspeakers 134.

The functions illustrated by the noise suppressor 121 can also be viewed as means for applying a noise suppression to an original audio signal to obtain an audio signal with reduced noise. The functions illustrated by the mode selector 123 can also be viewed as means for selecting a coding mode based on the audio signal with reduced noise. The functions illustrated by the encoder 124 can also be viewed as means for encoding the original audio signal using the determined coding mode.

It is to be understood that the embodiment presented with reference to FIG. 1 can be varied in many ways. For instance, one or both of the electronic devices 110, 130 could be another device than a mobile terminal. One of the electronic devices could be, by way of example, a personal computer, etc. Further, the functions of the integrated circuit 120 could also be realized by discrete components or by software. Further, the mode selection may be based on another type of parameter analysis than a pitch analysis, etc.

Figure 3:
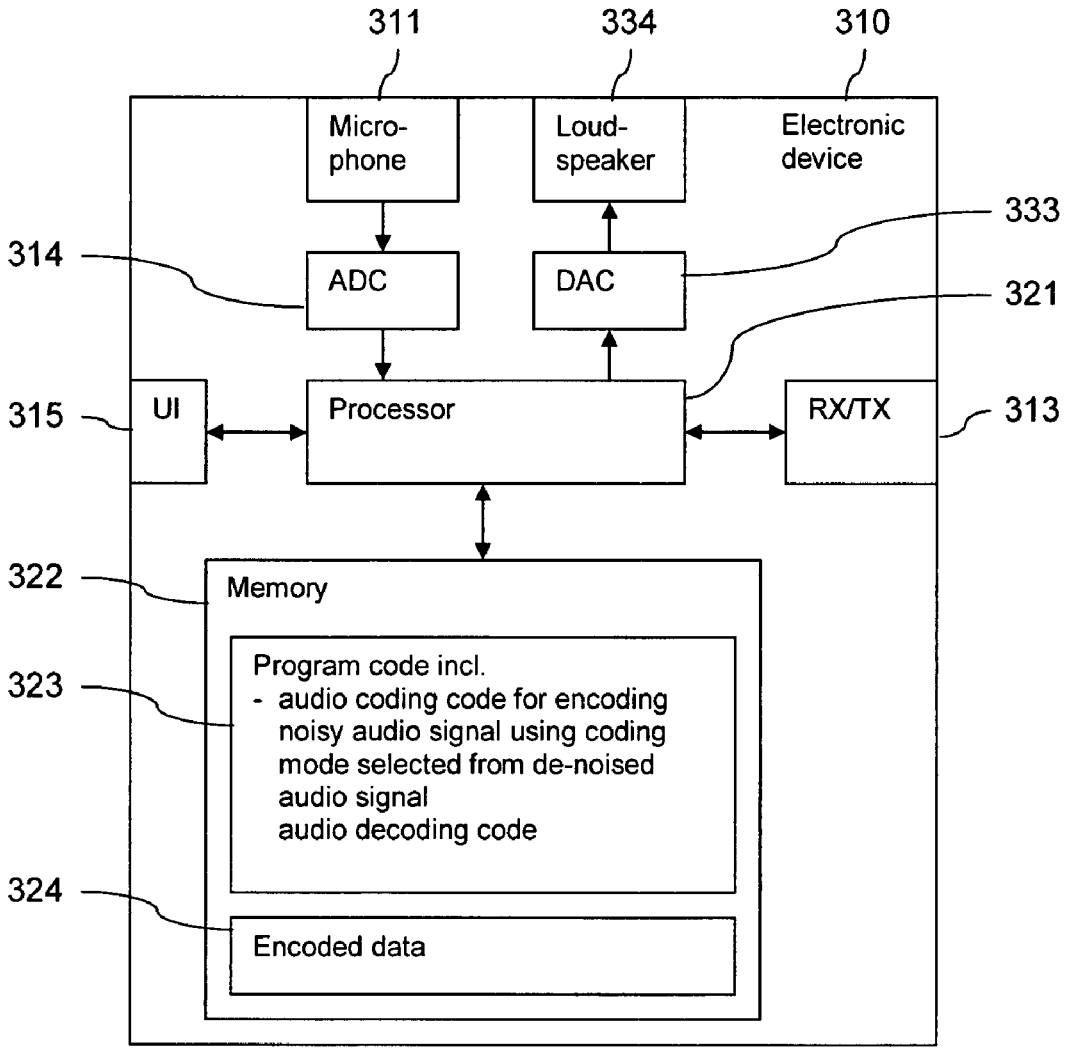
FIG. 3 is a schematic block diagram of an electronic device according to an embodiment of the invention.

FIG. 3 is a schematic block diagram of an exemplary electronic device 310, which enables a coding mode selection in accordance with a second embodiment of the invention.

The electronic device 310 could be again for example a mobile terminal of a wireless communication system. The electronic device 310 could be considered as an exemplary embodiment of the apparatus according to the invention.

It comprises a microphone 311, which is linked via an analog-to-digital converter 314 to a processor 321. The processor 321 is further linked via a digital-to-analog converter 333 to loudspeakers 334. The processor 321 is further linked to a transceiver (TX/RX) 313, to a user interface (UI) 315 and to a memory 322.

The processor 321 is configured to execute various program codes. The implemented program codes comprise an audio encoding code for encoding a noisy audio signal using a coding mode that has been selected based on a de-noised audio signal. The implemented program codes further comprise an audio decoding code. The implemented program codes 323 may be stored for example in the memory 322 for retrieval by the processor 321 whenever needed. The memory 322 could further provide a section 324 for storing data, for example data that has been encoded in accordance with the invention.

The user interface 315 enables the user to input commands to the electronic device 310, for example via a keypad, and/or to obtain information from the electronic device 310, for example via a display. The transceiver 313 enables a communication with other electronic devices, for example via a wireless communication network.

It is to be understood again that the structure of the electronic device 310 could be supplemented and varied in many ways.

A user of the electronic device 310 may use the microphone 311 for inputting audio data that is to be transmitted to some other electronic device or that is to be stored in the data section 324 of the memory 322. A corresponding application has been activated to this end by the user via the user interface 315. This application, which may be run by the processor 321, causes the processor 321 to execute the encoding code stored in the memory 322.

The analog-to-digital converter 314 converts the input analog audio signal into a digital audio signal and provides the digital audio signal to the processor 321.

The processor 321 may then process the digital audio signal in the same way as described with reference to FIG. 3 for the electronic device 110 of FIG. 1.

The resulting bit stream is provided as an embedded bit stream to the transceiver 313 for transmission to another electronic device. Alternatively, the coded data could be stored in the data section 324 of the memory 322, for instance for a later transmission or for a later presentation by the same electronic device 310.

The electronic device 310 could also receive a bit stream with correspondingly encoded data from another electronic device via its transceiver 313. In this case, the processor 321 may execute the decoding program code stored in the memory 322. The processor 321 decodes the received data or a suitable subset of the data in the embedded bit stream and provides the decoded data to the digital-to-analog converter 333. The digital-to-analog converter 333 converts the digital decoded data into analog audio data and outputs them via the loudspeakers 334. Execution of the decoding program code could be triggered as well by an application that has been called by the user via the user interface 315.

The received encoded data could also be stored instead of an immediate presentation via the loudspeakers 334 in the data section 324 of the memory 322, for instance for enabling a later presentation or a forwarding to still another electronic device.

The functions illustrated by the processor 321 executing the encoding code can also be viewed as means for applying a noise suppression to an original audio signal to obtain an audio signal with reduced noise; as means for selecting a coding mode based on the audio signal with reduced noise; and as means for encoding the original audio signal using the determined coding mode.

Alternatively, the functional modules of the encoding code can also be viewed as means for applying a noise suppression to an original audio signal to obtain an audio signal with reduced noise; as means for selecting a coding mode based on the audio signal with reduced noise; and as means for encoding the original audio signal using the determined coding mode.

On the whole, the presented embodiments of the invention enable a selection of a suitable coding mode for encoding audio data, even if the actual encoding is to be applied to noisy audio data without noise suppression. The presented enhanced mode selection results in an improved performance of an audio coding.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures.

What is claimed is:

1. A method comprising:

applying a noise suppression to an original audio signal to obtain an audio signal with reduced noise;

selecting a coding mode based on said audio signal with reduced noise; and encoding said original audio signal using said selected coding mode; wherein said encoding is performed on said original audio signal which has not had noise suppression applied.

2. The method according to claim 1, wherein a parameter analysis is applied to said audio signal with reduced noise, and wherein results of said analysis are used as a basis for selecting said coding mode.

3. The method according to claim 1, wherein a pitch analysis is applied to said audio signal with reduced noise and wherein results of said pitch analysis and said audio signal with reduced noise are used as a basis for selecting said coding mode.

4. The method according to claim 3, wherein said encoding of said original audio signal uses in addition results of said pitch analysis.

5. The method according to claim 1, wherein said coding mode selection based on said audio signal with reduced noise is employed only for a low bit rate coding in a variable bit rate coding.

6. An apparatus comprising a decoding component arranged to decode an audio signal encoded according to the method of claim 1.

7. The method according to claim 1, wherein said encoding of said original audio signal is an embedded variable bit rate coding.

8. An apparatus comprising:

a noise suppressor configured to apply a noise suppression to an original audio signal to obtain an audio signal with reduced noise;

a mode selector configured to select a coding mode based on said audio signal with reduced noise provided by said noise suppressor; and an encoder configured to encode said original audio signal using a coding mode selected by said selection component; wherein said encoder is configured to perform said encoding on said original audio signal which has not had noise suppression applied.

9. The apparatus according to claim 8, further comprising an analysis component configured to apply a parameter analysis to said audio signal with reduced noise, wherein said mode selector is configured to use results of said analysis as a basis for selecting said coding mode.

10. The apparatus according to claim 8, further comprising an pitch estimator configured to apply a pitch analysis to said audio signal with reduced noise, wherein said mode selector is configured to use results of said pitch analysis and said audio signal with reduced noise as a basis for selecting said coding mode.

11. The apparatus according to claim 10, wherein said encoder is configured to encode said original audio signal using in addition results of said pitch analysis.

12. The apparatus according to claim 8, wherein said encoder is configured to apply a variable bit rate coding to said original audio signal, and wherein said mode selector is configured to select a coding mode based on said audio signal with reduced noise only in case a low bit rate coding is to be applied by said coding component.

13. An electronic device comprising:

an apparatus according to claim 8; and an audio signal interface.

14. A system comprising:

an apparatus according to claim 8; and an apparatus comprising a decoding component configured to decode an audio signal encoded by said apparatus according to claim 8.

15. The apparatus according to claim 8, wherein said coding component is configured to apply an embedded variable bit rate coding to said original audio signal.

16. An apparatus comprising at least one processor and at least one computer readable medium including program code, the at least one computer readable medium and program code configured to, with the at least one processor, cause the apparatus at least to perform:

applying a noise suppression to an original audio signal to obtain an audio signal with reduced noise;

selecting a coding mode based on said audio signal with reduced noise; and encoding said original audio signal using said selected coding mode, wherein said encoding is performed on said original audio signal which has not had noise suppression applied.

17. The apparatus according to claim 16, wherein said program code causes the apparatus to apply a parameter analysis to said audio signal with reduced noise, and to use results of said analysis as a basis for selecting said coding mode.

18. The apparatus according to claim 16, wherein said program code causes the apparatus to apply a pitch analysis to said audio signal with reduced noise and to use results of said pitch analysis and said audio signal with reduced noise as a basis for selecting a coding mode.

19. The computer program product according to claim 18, wherein said program code causes the apparatus to use results of said pitch analysis in addition for encoding said original audio signal.

20. The computer program product according to claim 16, wherein said coding mode selection based on said audio signal with reduced noise is employed only for a low bit rate coding in a variable bit rate coding.

21. The computer program product according to claim 16, wherein said encoding of said original audio signal is an embedded variable bit rate coding.

22. An apparatus comprising:

means for applying a noise suppression to an original audio signal to obtain an audio signal with reduced noise;

means for selecting a coding mode based on said audio signal with reduced noise; and means for encoding said original audio signal using said selected coding mode, wherein said means for encoding is performed on said original audio signal which has not had noise suppression applied.

23. The apparatus according to claim 22, further comprising means for applying a pitch analysis to said audio signal with reduced noise, wherein said means for selecting a coding mode use results of said pitch analysis as a basis for selecting said coding mode.

* * * * *